US011623457B2

(12) United States Patent
Muller et al.

(10) Patent No.: US 11,623,457 B2
(45) Date of Patent: Apr. 11, 2023

(54) DETERMINATION OF RENDERING SPEED BASED ON THE MEASURED TEMPERATURE OF A CURING MODULE

(71) Applicant: Hewlett-Packard Development Company, L.P., Spring, TX (US)

(72) Inventors: Andreas Muller, Sant Cugat del Valles (ES); Manuel Agudo Acemel, Sant Cugat del Valles (ES); Pau Costal Fornells, Sant Cugat del Valles (ES); Albert Franco Morera, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 265 days.

(21) Appl. No.: 17/049,714

(22) PCT Filed: Jun. 15, 2018

(86) PCT No.: PCT/US2018/037742
§ 371 (c)(1),
(2) Date: Oct. 22, 2020

(87) PCT Pub. No.: WO2019/240814
PCT Pub. Date: Dec. 19, 2019

(65) Prior Publication Data

US 2021/0129559 A1 May 6, 2021

(51) Int. Cl.

| | |
|---|---|
| ***B41J 11/00*** | (2006.01) |
| ***B41J 19/20*** | (2006.01) |
| ***B41J 19/18*** | (2006.01) |

(52) U.S. Cl.
CPC ..... *B41J 11/0021* (2021.01); *B41J 11/00242* (2021.01); *B41J 19/18* (2013.01); *B41J 19/205* (2013.01)

(58) Field of Classification Search
CPC ..... B41J 11/0021; B41J 11/00242; B41J 19/205; B41J 19/18
See application file for complete search history.

(56) References Cited

U.S. PATENT DOCUMENTS

| | | | |
|---|---|---|---|
| 5,170,215 | A | 12/1992 | Pfeuffer |
| 6,148,163 | A | 11/2000 | Ito |
| 6,872,018 | B2 | 3/2005 | Jung |
| 6,885,832 | B2 | 4/2005 | Osada |
| 7,054,571 | B2 | 5/2006 | Camp et al. |
| 7,184,679 | B2 | 2/2007 | Wu et al. |
| 9,268,284 | B2 | 2/2016 | Yokoyama et al. |
| 2006/0119670 | A1 | 6/2006 | DeVore |

(Continued)

*Primary Examiner* — Henok D Legesse

(57) ABSTRACT

The disclosure relates to a rendering apparatus, method and non-transitory machine-readable storage medium for determining a speed of a carriage during rendering of an image. A plurality of swaths of rendering fluid are deposited on a print target using a set of printheads moving across the print target. A temperature of a curing module is measured at a respective time of depositing each respective swath. An arrival time for each deposited swath to respectively arrive at the curing module is predicted. The speed of the carriage during depositing the plurality of swaths is determined based on the measured temperature of the curing module and predicted arrival time for each respective swath.

14 Claims, 5 Drawing Sheets

(56) References Cited

U.S. PATENT DOCUMENTS

| | | | | |
|---|---|---|---|---|
| 2006/0192829 | A1* | 8/2006 | Mills | B41J 2/01 347/102 |
| 2013/0293620 | A1 | 11/2013 | Tunmore | |
| 2014/0176635 | A1* | 6/2014 | Portela Mata | B41J 29/377 347/19 |
| 2015/0367652 | A1* | 12/2015 | Gracia Verdugo | B41J 11/002 347/16 |
| 2017/0246858 | A1 | 8/2017 | Valle De La Munoza et al. | |

* cited by examiner

DETERMINATION OF RENDERING SPEED BASED ON THE MEASURED TEMPERATURE OF A CURING MODULE

BACKGROUND

To render an image on a print target or media a user may instruct a rendering apparatus. The time taken between the moment the user submits the rendering request and the start of the rendering process by the rendering apparatus is referred to as the "click to print" time. For example, the rendering process may begin when a part of the rendering apparatus initiates an action to render the image.

BRIEF DESCRIPTION OF THE DRAWINGS

Various features and advantages of certain examples will be apparent from the detailed description which follows, taken in conjunction with the accompanying drawings, which together illustrate, by way of example only, a number of features, and wherein.

DETAILED DESCRIPTION

In the following description, for purposes of explanation, numerous specific details of certain examples are set forth, Reference in the specification to "an example" or similar language means that a particular feature, structure, or characteristic described in connection with the example is included in at least that one example, but not necessarily in other examples.

According to an example the rendering apparatus comprises a curing module. For example, the rendering apparatus may be an inkjet printer, e.g., a latex printer.

According to the apparatus and methods described there is provided a rendering apparatus with a curing system, such as a latex printer, that gives a user perception of immediacy despite warm-up times of the curing system. A dynamic speed of the carriage is applied in accordance to that of a warm-up time and/or target operating temperature of the rendering apparatus heating system.

Figure 1:
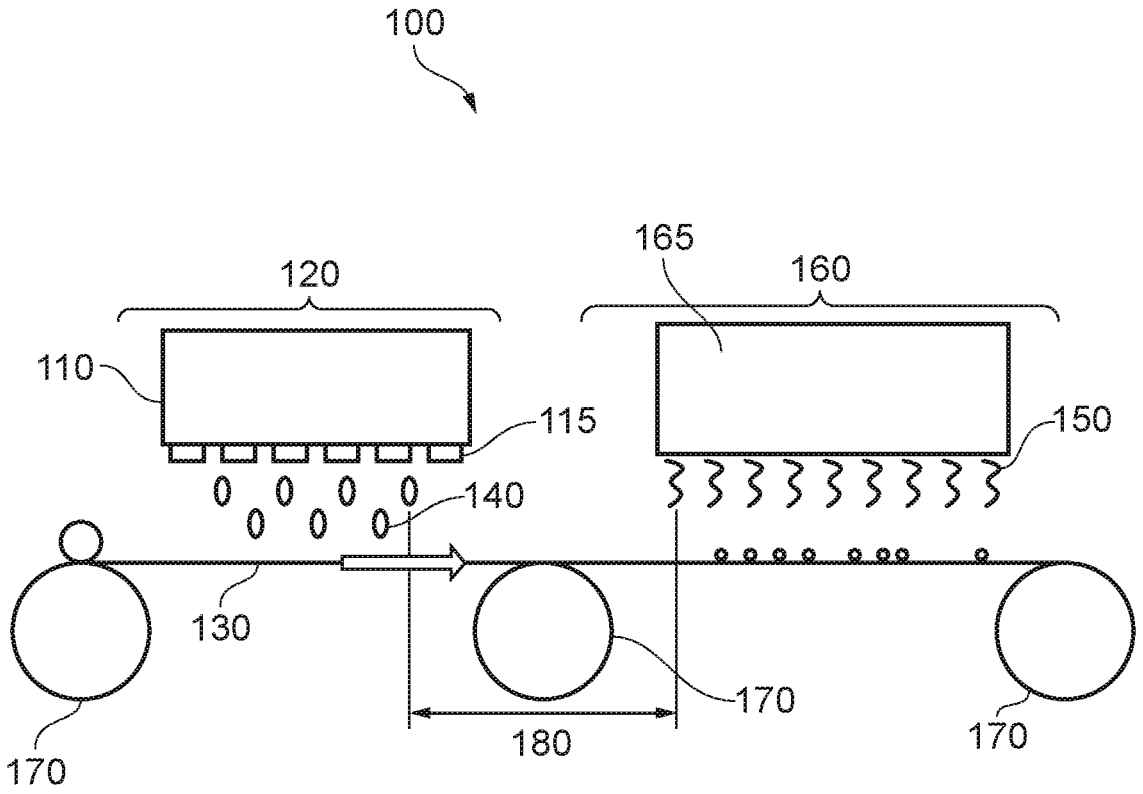
FIG. 1 is a schematic showing a rendering apparatus according to an example.

FIG. 1 is a schematic showing a rendering apparatus 100. The rendering apparatus may comprise a carriage 110 with a set of printheads 115. The carriage may be located in a print zone 120. The carriage may move bidirectionally along a swath direction over the print target 130 during the rendering process to deposit rendering fluid 140 on the print target (in FIG. 1 the carriage 110 moves into or out of the page). The print target with the rendering fluid may then be exposed to heat 150 to cure the rendering fluid and fix the image. The print target may be transported to a curing zone 160. For example, a curing module 165 may be provided to supply heat to the deposited rendering fluid on the print target. Rollers 170 may be provided throughout the rendering apparatus to transport the print target with the rendered image between different zones. For example, the print target may be transported between two rollers that create a nip point. According to an example, the carriage and printheads can move or translate along an x-direction. The x-direction is perpendicular to a y-direction along which the print target moves, i.e., the media advance direction. The print zone and curing zone may be displaced along the y-direction. There may be a distance 180 between the last drop of rendering fluid deposited on the print target during a deposition of a swath and the curing zone.

According to an example, the speed of the carriage corresponds to a speed of the printheads moving across the print target.

According to an example, there is provided an apparatus for rendering an image on a print target. The apparatus may be a rendering apparatus comprising a set of printheads, a curing module, a temperature sensor and a processor. The printheads are configured or arranged to deposit a plurality of swaths of rendering fluid on the print target. The swaths are deposited as the carriage moves across a surface of the print target. For example, the carriage may move back and forth in a direction that is perpendicular to a transport direction of the print target or media advance direction. The curing module may be arranged to operate at a temperature between 40-120 degrees Celsius or as an example it can operate at a target temperature of 95 degrees Celsius. The temperature sensor may be located in the curing zone or in close proximity to the curing module to measure a temperature associated to the curing module. The temperature of the curing module may be monitored continuously such that the temperature of the curing module is measured at a respective time of depositing each respective swath. The processor is configured to receive the measured temperature of the curing module at the respective time of depositing each respective swath. Based on the carriage speed during deposition of the swaths and the distance from the printhead positions and the curing module, the processor can predict an arrival time for each deposited swath to respectively arrive at the curing module. As such, the processor can determine a speed of the carriage during depositing of the plurality of swaths based on the measured temperature of the curing module and the predicted arrival time for each respective swath.

According to an example, the speed of the carriage is determined and an alignment of the printheads between swaths of different carriage speeds may be corrected. For example, the alignment may vary between speeds for bi-directional rendering (forward and backward). This can ensure adequate positioning of each drop of rendering fluid fired onto the print target.

According to an example, the rendering of each swath is started before a curing module reaches temperature. For example, the carriage speed can be slower whilst the curing module has yet to reach a target operating temperature and increased to a higher speed when the target operating temperature is reached.

Figure 2:
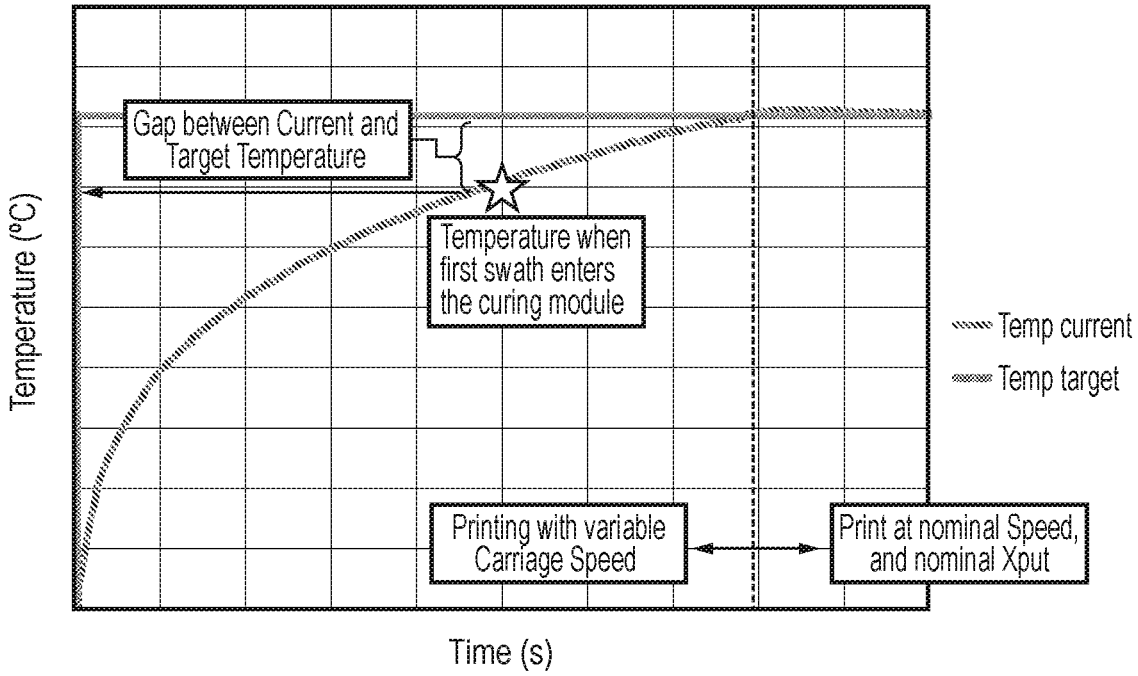
FIG. 2 shows a schematic of a warm-up cycle for a curing module to an operating temperature according to an example.

FIG. 2 shows a schematic of a warm-up cycle for a curing module to an operating temperature. Rendering systems, such as latex printers, with a curing system reach a target operating temperature in a pre-determined amount of time. The target operating temperature enables adequate heating of the curing system for performance with adequate curing conditions and image quality. For example, the warm-up time for a heating system can be characterized against a number of printhead passes at different speeds (or different media advance lengths). A certain number of advances at a reduced carriage speed may bridge the time for the curing module to reach target temperature. Several different carriage speeds may be used such as starting at a slower speed and increasing to higher speeds when certain temperature thresholds are reached. The temperature sensor in the curing module can provide information on a current temperature of the curing module.

According to an example, if the curing module exceeds a target operating temperature, the print target may deform or cause image quality and/or media jamming issues. According to an example, if a target operating temperature has not yet been reached the carriage speed may be adjusted.

According to an example, the curing temperature depends on media throughput and/or rendering fluid density. The media throughput rate relates to the rate at which the media passes through the rendering apparatus and hence the curing module. For example, a higher throughput can give less exposure time of the rendering fluid to the thermal energy in the curing module. Hence, this may lead to a higher target operating temperature to maintain an adequate image quality. The throughput may be linked to the carriage speed.

According to an example, the actual temperature of the curing system may be the trigger for setting or changing the carriage speed. The table below shows example carriage speeds (inches per second, ips) for different actual temperatures of the curing module.

| Actual Curing Temperature | Carriage Speed |
|---|---|
| 40° C. | 30 ips (start rendering) |
| 60° C. | 40 ips |
| 80° C. | 50 ips |
| 95° C. (Target) | 60 ips |

According to an example, there is provided a rendering apparatus with a heating system that may be characterized for curing module warm-up times in different conditions. The number of swath (or printhead passes) at a reduced carriage speed may be calculated to allow the heating system to be at the target temperature when the first swath reaches the curing module. After the defined amount of swath at the lower carriage scanning speed the rendering system may increase the carriage scanning speed to deposit swaths at a faster rate.

Curing performance may be driven by an exposure time of the rendered image to heat. For example, if the target curing temperature is not met by the time the first swath reaches the curing zone, a reduced carriage speed can be maintained. This increases the exposure time of the rendered image to the curing temperature below the target temperature such that curing performance may not be affected. According to an example, complete curing can occur at different temperature points (above a certain minimum temperature) when the exposure time is long enough. The curing performance at different temperatures vs. carriage speed can be characterized and one or several temperature thresholds are defined for each media category at which curing will be defect free at a reduced carriage speed.

According to an example, each printhead may fire one or more drops of rendering fluid onto the print target. The speed at which the carriage transverses the print target will affect the position on the print target at which each drop will land. The carriage may move across the print target in a first direction (forward scanning) at a different speed to that in a second (backward scanning), opposite direction to the first. The different forward and backward scanning speeds influence the drops and their falling positions differently. As such, a first printhead alignment may provided for a forward scanning direction and a second printhead alignment may be provided for a backward scanning direction. According to an example, there is provided a print-engine setup which can access an adequate printhead or pen alignment correction for each carriage speed and direction. The rendering system may be aligned or re-aligned between swaths of at least two different carriage speeds. According to an example for a backward pass, two alignment points for two different carriage speeds may be used to obtain a correction for a third speed based on an interpolation.

Figure 3:
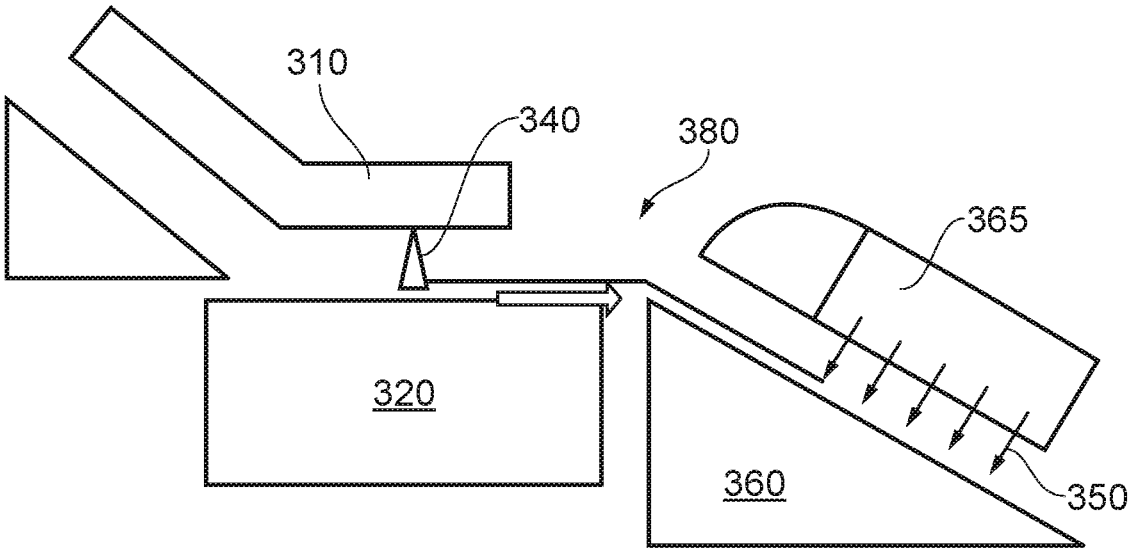
FIG. 3 is a schematic showing different zones of a rendering apparatus according to an example.

FIG. 3 is a schematic showing different zones of a rendering apparatus according to an example. The distance which a deposited drop of rendering fluid travels to be affected by heat from the curing module varies depending on the printhead nozzles used to fire each drop and the carriage speed at the time of firing each drop. There are a set of distances 380 between a drop of rendering fluid 340 deposited on the print target and the curing zone. There is a distance between the last drop of rendering fluid and the curing module; for example, the distance between a first printhead nozzle to the curing zone may be approximately 280 mm; the distance between a last printhead nozzle to the curing zone may be approximately 215 mm; and/or the distance between a last printhead nozzle comprising an overcoat rendering fluid may be approximately 193 mm, where the overcoat rendering fluid may be deposited after the other rendering fluids have been deposited.

As shown in FIG. 3, the rendering apparatus comprises a carriage 310 with a set of printheads located in a print zone 320. The carriage moves across a print target in forward and/or backward scanning modes. During the rendering process rendering fluid 340 is deposited onto the print target. The print target with the rendering fluid is then transported to a curing zone 360 where it is exposed to heat 350 from a curing module 365 in order to cure the rendering fluid and fix the rendered the image. A transport mechanism, such as rollers, is provided throughout the rendering apparatus to transport the print target and rendered image between different zones.

Figure 4:
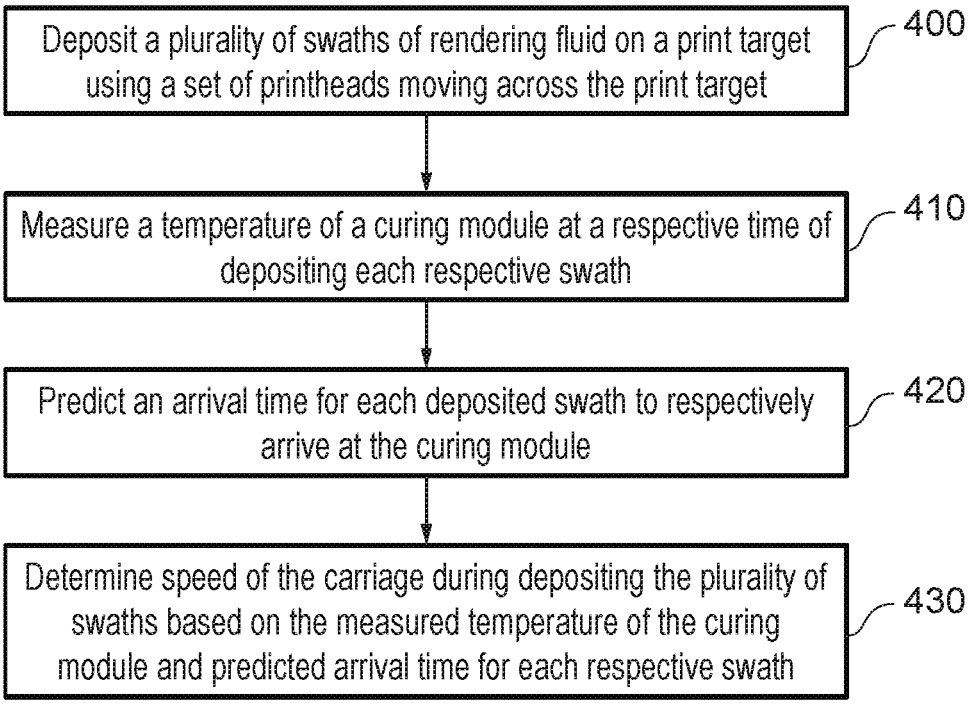
FIG. 4 shows a flow chart for determining the speed of a carriage during a rendering process according to an example.

FIG. 4 shows a flow chart for determining the speed of a carriage during a rendering process.

At block 400 a plurality of swaths of rendering fluid are deposited on a print target. The rendering fluid is deposited using a set of printheads in a carriage moving across the print target. The carriage movement may be continuous during the rendering of the image.

At block 410 a temperature of a curing module is measured at a respective time of depositing each respective swath. For example, the swaths are deposited in the print zone and the print target is transported to the curing module in the curing zone to permanently fix the rendered image onto the print target. A temperature sensor positioned in the curing module may provide a reading of a current temperature to a processor in the rendering apparatus.

At block 420 the processor predicts an arrival time for each deposited swath to respectively arrive at the curing module. For example, consider a first swath deposited at time t1 and subsequent swaths deposited at times t2 to tn, where n is the number of swaths deposited. The time take for the first swath to arrive at the curing module will depend upon the speed of the carriage during deposition of the subsequent swaths. The processor is able to record the speed of the carriage for each swath and using the distance from the printheads to the curing module can calculate or predict the time that will lapse until the first swatch reaches the curing module.

At block 430 the speed of the carriage during depositing the plurality of swaths is varied based on the measured temperature of the curing module and predicted arrival time for each respective swath. For example, the processor can reference a warm-up cycle or look-up-table for the curing module and can use the measure temperature to calculate a remaining time for the curing module to reach a particular target temperature. According to an example, if the predicted remaining time to reach the target operating temperature exceeds the predicted time for the first swath to reach the curing module, the carriage speed may be reduced. The arrival time for each deposited swath to respectively arrive at the curing module can be predicted using a distance from the printhead to the curing module and a speed of the carriage during depositing of subsequent swaths. As such, a balance may be struck between the time take for the curing module to reach an operating temperature and the time in which the first swath reaches the curing module. This can ensure that the first swath reaches the curing module when the heat is adequate or sufficient to cure the rendering fluid without thermal deformation.

The speed of the carriage may depend upon a speed of advance of the print target as it moves towards the curing module. According to an example, as the rendering process progresses a dynamic adjustment of the carriage speed can be made taking account of an exposure time of each swath to a temperature of the curing module, for example, to ensure no thermal deformation. The exposure time of each respective swath to the temperature of the curing module can be calculated from the predicted arrival time for each respective swath and an expected temperature of the curing module at that future time, for example using the warm-up cycle of the curing module. The speed of the carriage may be reduced whereby to increase the time of arrival of a swath to the curing module or the speed of the carriage may be increased whereby to decrease the time of arrival of a swath to the curing module. As such, the speed of the carriage may be varied from swath to swath. The carriage speed may be lower before a first swath reaches the curing module and comparatively higher after the first swath reaches the curing module.

According to an example, the speed of the carriage may be varied based on the calculated exposure time of a swath to heat at the curing module.

According to an example, the speed of the carriage may be varied using a look-up-table comprising curing times for the rendering fluid at different curing module temperatures. The look-up-table may comprise temperature exposure thresholds for a plurality of media types, above which thresholds the rendered image has defects. This allows for a dynamic adjustment of the exposure time of the rendered image to thermal energy via an adjustment of the carriage speed.

An alignment of the printheads between swaths of different carriage speeds may be corrected.

According to an example, the method comprises the processor adjusting a temperature of the curing module. For example, the temperature of the curing module may be adjusted to the target temperature. For example, when the temperature of the curing module is below a target temperature the carriage speed may be comparatively lower than when the temperature of the curing module is at or above the target temperature.

According to an example, there is provided a method for reducing a rendering time in a rendering apparatus. A speed of a printhead or deposition structure is modified when depositing multiple swaths of rendering material on a target substrate according to: a time of arrival of a portion of a swath in a curing module of the rendering apparatus, and a target temperature of the curing module at the time of arrival. The method may further comprise reducing the speed of the deposition structure whereby to increase the time of arrival.

According to an example, a media advance speed is adjusted in addition to or alternatively to the carriage speed adjustment as described herein. For example, the media advance speed may be selected based on a temperature measurement performed at the curing module. The media advance speed may be modified simultaneously with the modification of the carriage speed or swath deposition speed in the rendering apparatus.

The apparatus and methods disclosed herein improve user experience when rendering an image by improving click to print times, i.e. it provides an immediate printing experience. The print module for the rendering of each swath is started with variable carriage speed from swath to swath before a curing module reaches a target operating temperature. The rendering apparatus does not have to wait for the curing module to reach the target operating temperature before printing, i.e. the click to print time does not depend upon the initial warm-up time of the curing module since rendering is started before the curing module reaches target temperature. The rendering process can begin the instant the user requests a rendered image. This is opposed to starting printing at some point during the warm up time of the curing module with a default (higher) carriage speed with applied inter-swath delays between passes of the printheads. Although this latter approach can launch the first pass before the curing module reaches a target temperature, the inter-swath delays create an immediacy issue as the printer is seen by the user as on hold for several seconds after each swath. As such, the present disclosure improves immediacy perception for the user. This is achieved despite warm-up times for the curing module.

The described methods reduce the exposure time of certain regions of the print target during curing due to the continuous movement of the carriage during the rendering process, i.e. no inter-swath delays are present. This reduces thermal deformation of the print target since each part of the media is exposed for more even amounts of time to heat from the curing module, i.e. the print target moves continuously through the print zone and curing zone to even out any hot spots on the media whilst in the curing module. This assures an adequate curing performance for the rendered image. The reduction in thermal deformation of the print target further reduces media crashes where the print target becomes jammed in the rendering apparatus.

According to an example, the methods and apparatus described provide a more uniform layer of rendering fluid in the rendered image over the course of the rendering process since long static exposures to heat during can be avoided.

Examples in the present disclosure can be provided as methods, systems or machine-readable instructions, such as any combination of software, hardware, firmware or the like. Such machine-readable instructions may be included on a computer readable storage medium (including but not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. In some examples, some blocks of the flow diagrams may not be necessary and/or additional blocks may be added. It shall be understood that each flow and/or block in the flow charts and/or block diagrams, as well as combinations of the flows and/or diagrams in the flow charts and/or block diagrams can be realized by machine readable instructions.

The machine-readable instructions may, for example, be executed by a general-purpose computer, a special purpose computer, an embedded processor or processors of other programmable data processing devices to realize the functions described in the description and diagrams. In particular, a processor or processing apparatus may execute the machine-readable instructions. Thus, modules of apparatus may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate set etc. The methods and modules may all be performed by a single processor or divided amongst several processors.

Such machine-readable instructions may also be stored in a computer readable storage that can guide the computer or other programmable data processing devices to operate in a specific mode.

For example, the instructions may be provided on a non-transitory computer readable storage medium encoded with instructions, executable by a processor.

Figure 5:
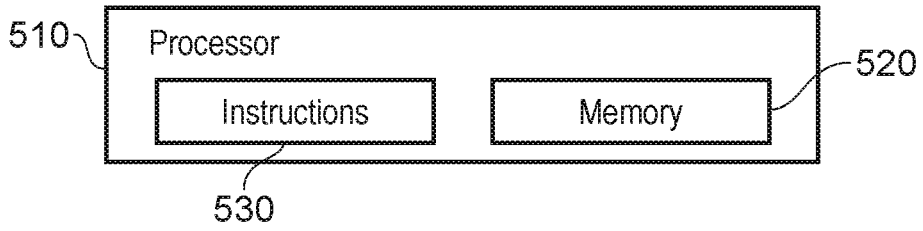
FIG. 5 shows a processor of a rendering apparatus according to an example.

According to an example, a non-transitory machine-readable storage medium may be encoded with instructions executable by a processor. FIG. 5 shows an example of a processor 510 associated with a memory 520. The memory 520 comprises computer readable instructions 530 which are executable by the processor 510 for determining a speed of a carriage during rendering of an image. The instructions 530 comprise:

Instructions to receive a measured temperature of a curing module at a respective time of depositing each respective swath in a plurality of swaths deposited by a set of printheads on a print target as the carriage moves;

Instructions to predict an arrival time for each deposited swath to respectively arrive at a curing module; and Instructions to determine a speed of the carriage during depositing the plurality of swaths based on the measured temperature of the curing module and predicted arrival time for each respective swath.

Such machine-readable instructions may also be loaded onto a computer or other programmable data processing devices, so that the computer or other programmable data processing devices perform a series of operations to produce computer-implemented processing, thus the instructions executed on the computer or other programmable devices provide a operation for realizing functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. In particular, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method of determining a speed of a carriage during rendering of an image, comprising:

depositing a plurality of swaths of rendering fluid on a print target using a set of printheads moving across the print target;

measuring a temperature of a curing module at a respective time of depositing each respective swath;

predicting an arrival time for each deposited swath to respectively arrive at the curing module, wherein the predicted arrival time for each deposited swath to respectively arrive at the curing module is calculated using a distance from the printhead to the curing module and a speed of the carriage during depositing of subsequent swaths; and determining the speed of the carriage during depositing the plurality of swaths based on the measured temperature of the curing module and predicted arrival time for each respective swath.

2. The method according to claim 1, further comprising correcting an alignment of the printheads between swaths of different carriage speeds.

3. The method according to claim 1, wherein the carriage movement is continuous during rendering of the image.

4. The method according to claim 1, wherein the speed of the carriage is determined for each swath.

5. The method according to claim 1, wherein the carriage speed is lower before a first swath reaches the curing module and is higher after the first swath reaches the curing module.

6. The method according to claim 1, wherein the carriage speed is determined to be a lower speed if the temperature of the curing module is below a target temperature and is determined to be a speed higher than the lower speed if the target temperature is at or above the target temperature.

7. The method according to claim 1, further comprising calculating an exposure time of each respective swath to the temperature of the curing module from the predicted arrival time for each respective swath.

8. The method according to claim 7, further comprising determining the speed of the carriage based on the calculated exposure time.

9. The method according to claim 1, further comprising determining the speed of the carriage using a look-up-table comprising curing times for the rendering fluid at different curing module temperatures.

10. The method according to claim 9, wherein the look-up-table further comprises temperature exposure thresholds for a plurality of media types, above which thresholds the rendered image has defects.

11. The method according to claim 1, wherein a media advance rate is determined for each swath.

12. An Apparatus for rendering an image on a print target, comprising:

a set of printheads arranged to deposit a plurality of swaths of rendering fluid on the print target as a carriage moves;

a curing module;

a temperature sensor to measure a temperature of the curing module at a respective time of depositing each respective swath; and a processor configured to:

receive the measured temperature of the curing module at the respective time of depositing each respective swath, predict an arrival time for each deposited swath to respectively arrive at the curing module, wherein the predicted arrival time for each deposited swath to respectively arrive at the curing module is calculated using a distance from the printhead to the curing module and a speed of the carriage during depositing of subsequent swaths, and determine a speed of the carriage during depositing the plurality of swaths based on the measured temperature of the curing module and predicted arrival time for each respective swath.

13. The apparatus according to claim 12, wherein the rendering apparatus is a latex printer.

14. A non-transitory machine-readable storage medium encoded with instructions executable by a processor for determining a speed of a carriage during rendering of an image, the machine-readable storage medium comprising instructions to:

receive a measured temperature of a curing module at a respective time of depositing each respective swath in a plurality of swaths deposited by a set of printheads on a print target as the carriage moves;

predict an arrival time for each deposited swath to respectively arrive at a curing module, wherein the predicted arrival time for each deposited swath to respectively arrive at the curing module is calculated using a distance from the printhead to the curing module and a speed of the carriage during depositing of subsequent swaths; and determine a speed of the carriage during depositing the plurality of swaths based on the measured temperature of the curing module and predicted arrival time for each respective swath.

* * * * *